US007641316B2

(12) United States Patent
Sakai et al.

(10) Patent No.: US 7,641,316 B2
(45) Date of Patent: Jan. 5, 2010

(54) INK JET HEAD CIRCUIT BOARD, METHOD OF MANUFACTURING THE SAME AND INK JET HEAD USING THE SAME

(75) Inventors: Toshiyasu Sakai, Yokohama (JP); Teruo Ozaki, Yokohama (JP); Kenji Ono, Tokyo (JP); Ichiro Saito, Yokohama (JP); Sakai Yokoyama, Kawasaki (JP); Satoshi Ibe, Yokohama (JP); Kazuaki Shibata, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 30 days.

(21) Appl. No.: 11/203,130

(22) Filed: Aug. 15, 2005

(65) Prior Publication Data

US 2006/0033782 A1 Feb. 16, 2006

(30) Foreign Application Priority Data

Aug. 16, 2004 (JP) ..... 2004-236607

(51) Int. Cl.
*B41J 2/05* (2006.01)

(52) U.S. Cl. ..... 347/64; 347/58; 347/63; 347/67; 257/4; 257/139; 257/275; 257/532; 257/758; 438/103; 438/253; 438/254

(58) Field of Classification Search ..... 347/58, 347/63, 64, 65, 67; 216/27; 257/4, 139, 257/275, 532, 758, 797
See application file for complete search history.

(56) References Cited

U.S. PATENT DOCUMENTS 4,686,544 A * 8/1987 Ikeda et al. ..... 347/64
4,723,129 A 2/1988 Endo et al. ..... 346/1.1
4,740,796 A 4/1988 Endo et al. ..... 346/1.1

(Continued)

FOREIGN PATENT DOCUMENTS

EP 0 277 756 8/1988

(Continued)

OTHER PUBLICATIONS

Japanese Office Action dated Mar. 20, 2007, issued in corresponding Japanese patent application No. 2004-236607, with English-language translation.

*Primary Examiner*—Matthew Luu
*Assistant Examiner*—John P Zimmermann
(74) *Attorney, Agent, or Firm*—Fitzpatrick, Cella, Harper & Scinto

(57) ABSTRACT

An ink jet head circuit board is provided which has heaters to generate thermal energy for ink ejection as they are energized. This circuit board reduces areas of the heaters to achieve higher printing resolution and image quality. This board also prevents a degradation of thermal energy efficiency and reduces power consumption. The protective insulation layer for the electrode wire layer is formed of two layers and one of the two layers is removed from above the heater to improve the heat energy efficiency. The resistor layer is deposited over the electrode wire layer. The patterning for removing the protective insulation layer is done in a wider range than a gap of the electrode wire layer, the gap being used to form the heater. Further, by forming the electrode wires in two layers, a possible reduction in an effective bubble generation area of the heater can be prevented.

6 Claims, 21 Drawing Sheets

U.S. PATENT DOCUMENTS

| | | | | |
|---|---|---|---|---|
| 4,866,460 | A * | 9/1989 | Shiozaki | 347/58 |
| 5,081,474 | A | 1/1992 | Shibata et al. | |
| 5,479,197 | A | 12/1995 | Fujikawa et al. | |
| 5,491,505 | A | 2/1996 | Suzuki et al. | |
| 5,660,739 | A | 8/1997 | Ozaki et al. | 216/27 |
| 6,056,391 | A * | 5/2000 | Kasamoto et al. | 347/58 |
| 6,186,617 | B1 * | 2/2001 | Ahn | 347/67 |
| 6,315,853 | B1 * | 11/2001 | Kubota et al. | 156/257 |
| 6,357,862 | B1 * | 3/2002 | Ozaki et al. | 347/58 |
| 6,402,302 | B1 | 6/2002 | Ozaki et al. | |
| 6,443,563 | B1 | 9/2002 | Saito et al. | |
| 6,450,617 | B1 | 9/2002 | Kitani et al. | |
| 6,474,769 | B1 | 11/2002 | Imanaka et al. | |
| 6,513,911 | B1 | 2/2003 | Ozaki et al. | |
| 6,540,330 | B1 | 4/2003 | Kubota et al. | |
| 6,578,951 | B2 | 6/2003 | Ozaki et al. | |
| 6,609,783 | B1 | 8/2003 | Koyama et al. | |
| 6,688,729 | B1 | 2/2004 | Imanaka et al. | |
| 6,932,461 | B2 | 8/2005 | Usami et al. | |
| 2002/0003557 | A1 * | 1/2002 | Miyakoshi et al. | 347/58 |
| 2003/0210302 | A1 * | 11/2003 | Keefe et al. | 347/63 |
| 2004/0119789 | A1 * | 6/2004 | Usami et al. | 347/63 |
| 2005/0248623 | A1 | 11/2005 | Komuro et al. | |
| 2006/0033780 | A1 | 2/2006 | Ono et al. | |
| 2006/0146095 | A1 | 7/2006 | Sakai et al. | |
| 2006/0170734 | A1 | 8/2006 | Ibe et al. | |

FOREIGN PATENT DOCUMENTS

| | | |
|---|---|---|
| EP | 0 768 182 | 4/1997 |
| JP | 60-159062 | 8/1985 |
| JP | 6-198889 | 7/1994 |
| JP | 08-112902 | 5/1996 |
| JP | 8-216412 | 8/1996 |
| JP | 2001-287364 | 10/2001 |
| JP | 3382424 | 12/2002 |
| JP | 2004-195688 | 7/2004 |

* cited by examiner

INK JET HEAD CIRCUIT BOARD, METHOD OF MANUFACTURING THE SAME AND INK JET HEAD USING THE SAME

BACKGROUND OF THE INVENTION

1. Field of the Invention

The present invention relates to a circuit board for an ink jet head that ejects ink for printing, a method of manufacturing the circuit board, and an ink jet head using the circuit board.

2. Description of the Related Art

An ink jet printing system has an advantage of low running cost because an ink jet head as a printing means can easily be reduced in size, print a high-resolution image at high speed and even form an image on so-called plain paper that is not given any particular treatment. Other advantages include low noise that is achieved by a non-impact printing system employed by the print head and an ability of the print head to easily perform color printing using multiple color inks.

There are a variety of ejection methods available for the ink jet head to realize the ink jet printing system. Among others, ink jet heads using thermal energy to eject ink, such as those disclosed in U.S. Pat. Nos. 4,723,129 and 4,740,796, generally have a construction in which a plurality of heaters to heat ink to generate a bubble in ink and wires for heater electrical connection are formed in one and the same substrate to fabricate an ink jet head circuit board and in which ink ejection nozzles are formed in the circuit board over their associated heaters. This construction allows for easy and high-precision manufacture, through a process similar to a semiconductor fabrication process, of an ink jet head circuit board incorporating a large number of heaters and wires at high density. This helps to realize higher print resolution and faster printing speed, which in turn contributes to a further reduction in size of the ink jet head and a printing apparatus using it.

FIG. 1 and FIG. 2 are a schematic plan view of a heater in a general ink jet head circuit board and a cross-sectional view taken along the line II-II of FIG. 1. As shown in FIG. 2, on a substrate 120 is formed a resistor layer 107 as a lower layer, over which an electrode wire layer 103 is formed as an upper layer. A part of the electrode wire layer 103 is removed to expose the resistor layer 107 to form a heater 102. Electrode wire patterns 205, 207 are wired on the substrate 120 and connected to a drive element circuit and external power supply terminals for supply of electricity from outside. The resistor layer 107 is formed of a material with high electric resistance. Supplying an electric current from outside to the electrode wire layer 103 causes the heater 102, a portion where no electrode wire layer 103 exists, to generate heat energy creating a bubble in ink. Materials of the electrode wire layer 103 mainly include aluminum or aluminum alloy.

In such an ink jet head circuit board, the heater 102 is placed in an onerous environment in which it is subjected to a temperature rise and fall of about 1,000° C. in as little as 0.1-10 microseconds, to mechanical impacts caused by cavitations from repeated creation and collapse of bubbles, and also to erosion. For protection and insulation from ink, the heater 102 is provided with a protective insulation layer 108. This protective insulation layer is required to exhibit good performance in heat resistance, liquid resistance, liquid ingress prevention capability, oxidation stability, insulation, scratch or breakage resistance, and thermal conductivity, and is generally formed of inorganic compounds such as SiO and SiN. Further, because the single protective insulation layer alone may not be able to offer a sufficient protection of the resistor layer, there are cases where a layer of a more mechanically stable metal (e.g., Ta; this layer is generally called an anticavitation layer because of its capability to withstand damages from cavitations) is formed over the protective insulation layer 108 of SiO or SiN (see FIG. 2). In addition to the heater 102, the similar construction for preventing corrosions by ink is also provided for an electrode wire layer 103, which is used to make an electrical connection with a resistor layer 107.

The construction of these protective layers on the ink jet head circuit board constitutes an important factor that determines the performance of the ink jet head, such as its power consumption and service life.

In the construction of the conventional protective layer, however, reducing the power consumption and increasing the reliability of the layer and therefore its longevity are contradictory requirements.

For example, as the thickness of a layer between the heater resistor and a surface in contact with ink decreases, a heat conduction improves and the amount of heat escaping to other than ink decreases, reducing power consumption required to create bubbles. That is, the smaller the effective thickness of the protective layer deposited over the heater resistor, the better the energy efficiency. If on the other hand the protective layer is too thin, pin holes may be formed in the protective layer to expose the heater resistor or the protective layer may not be able to fully cover stepped portions of wires. As a result, ink may infiltrate through these insufficiently covered stepped portions, causing corrosions of wires and heater resistors, which in turn results in degraded reliability and shorter life span.

To deal with these problems, Japanese Patent No. 3382424 proposes a construction using first and second protective insulation layer, in which the first protective insulation layer is removed from above heaters to enhance energy efficiency, lower power consumption and increase reliability of the protective layers as a whole thereby prolonging their longevity.

FIG. 3 is a schematic cross-sectional view of a heater in an ink jet head circuit board disclosed in Japanese Patent No. 3382424 with a cross-sectioned portion corresponding to the line II-II of FIG. 1. In this construction, a first protective insulation layer 108*a* and a second protective insulation layer 108*b* are formed over the electrode wire layer 103 and the first protective insulation layer 108*a*, which is the lower layer, is removed from above the heater 102. This construction reduces the effective thickness of the protective layer over the heater 102 to improve the energy efficiency while at the same time providing a required protective insulation function by the second protective insulation layer 108*b*. Here, in order to fully cover stepped portions at those ends of the electrode wire layer 103 which face the heater 102, the first protective insulation layer 108*a* is removed from an area whose boundary is shifted inwardly of the heater from the ends of the electrode wire layer 103.

As ink jet printers are becoming more common in recent years, there are growing demands for higher printing resolution, higher image quality and faster printing speed. Of these demands, the high resolution and high image quality may be met, for example, by reducing the amount of ink ejected for one dot (reducing a diameter of an ink droplet when ink is ejected as a droplet). Conventional practice to achieve a reduction in the volume of ink ejected involves changing the shape of the nozzle (to reduce an orifice area) and reducing an area of each heaters.

It is known that although the heater is heated over its entire surface, a bubble is generated only in a central area 105 excluding a peripheral area, the peripheral area ranging from the edge of the heater to several micrometers inside, because a greater quantity of heat escapes from the periphery. This central area 105 is called an effective bubble generation area.

FIG. 4 shows this mechanism. In FIG. 4 a heater H almost square in plan view is shown connected to the electrode wire E. The peripheral portion N does not contribute to bubble formation and a central area, excluding the peripheral area ranging from the edge to a few micrometers inside, constitutes the effective bubble generation area. As can be seen from this figure, the greater the ratio of the effective bubble generation area A to the entire area of the heater H, the better the heat efficiency is.

FIG. 5 is a graph showing a relation between the size of the heater and a heat efficiency. The area not contributing to the bubble generation, or peripheral portion of the heater, has almost constant width irrespective of the area of the heater (normally 2-3 μm). So, as is seen from this diagram, as the area of the heater decreases to minimize the volume of ink ejected, the heat efficiency decreases.

Thus, if the construction disclosed in Japanese Patent No. 3382424 is adopted, the first protective insulation layer 108*a* is removed from an area whose boundary is shifted inwardly of the heater 102 from those ends of the electrode wire layer 103 facing the heater. In other words, the first protective insulation layer 108*a* lies up to a position inside the heater. As a result, the actual bubble generation area further decreases, degrading the heat efficiency. That is, in a present situation calling for reduced areas of the heaters, if the technique disclosed in Japanese Patent No. 3382424 is adopted as is, there is a problem of further degrading the heat efficiency.

SUMMARY OF THE INVENTION

It is therefore a main object of this invention to provide an ink jet head circuit board which can reduce the areas of heaters to achieve an improved printing resolution and a higher image quality while at the same time preventing a degradation of heat efficiency, increasing reliability and reducing power consumption.

Another object of this invention is to provide a small, highly reliable ink jet head with nozzles formed at high density.

In a first aspect of the present invention, there is provided an ink jet head circuit board having heaters to generate thermal energy for ejecting ink as they are energized; the ink jet head circuit board comprising:

an electrode wire layer having gap to form the heater;

a heater layer formed on the electrode wire layer and the gap;

a first protective layer formed on the electrode wire layer and the resistor layer and having wider gap above the heater than the gap of the electrode wire layer; and a second protective layer formed on the first protective layer and the gap of the first protective layer.

In a second aspect of the present invention, there is provided a method of manufacturing an ink jet head circuit board, wherein the ink jet head circuit board has heaters to generate thermal energy for ejecting ink as they are energized, the manufacturing method comprising the steps of:

forming an electrode wire layer on a substrate, the electrode wire layer having gap to form the heater;

forming a resistor layer on the electrode wire layer and the gap;

forming a first protective layer on the electrode wire layer and the resistor layer and removing the first protective layer from above the heater in a range wider than the gap of the electrode wire layer; and forming a second protective layer on the first protective layer including the range.

In a third aspect of the present invention, there is provided an ink jet head comprising:

the above ink jet head circuit board; and ink ejection nozzles corresponding to the heaters.

The basic construction of this invention is characterized by forming a protective layer in two layers and by removing one of the two layers from an area above the heater associated with power consumption of the ink jet head to reduce the effective thickness of the protective layer over the heater, thereby improving the heat efficiency and reducing power consumption. Further, because the resistor layer is deposited over the electrode wire layer, the patterning for removing the first protective layer can be done in a wider range than the gap of the electrode wire in which to form the heater. This allows the areas of the heaters to be reduced for higher printing resolution and higher image quality, without reducing the effective bubble generation area.

With this invention, a small, highly reliable ink jet head having nozzles formed at high density can be provided.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Now, the present invention will be described in detail by referring to the accompanying drawings.

Figure 1:
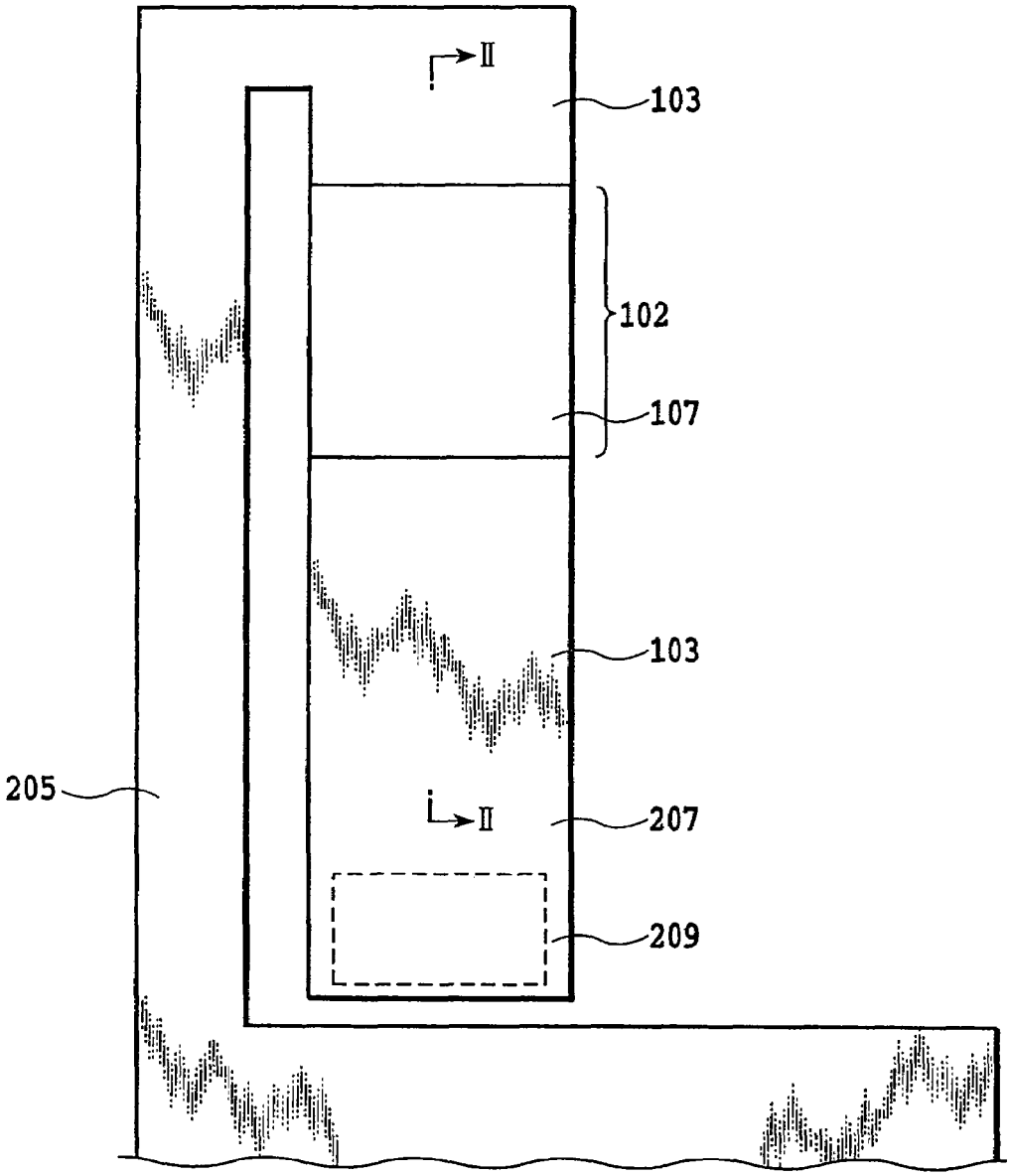
FIG.1 PRIOR ART
FIG. 1 is a schematic plan view showing a heater in a conventional ink jet head circuit board.
Figure 2:
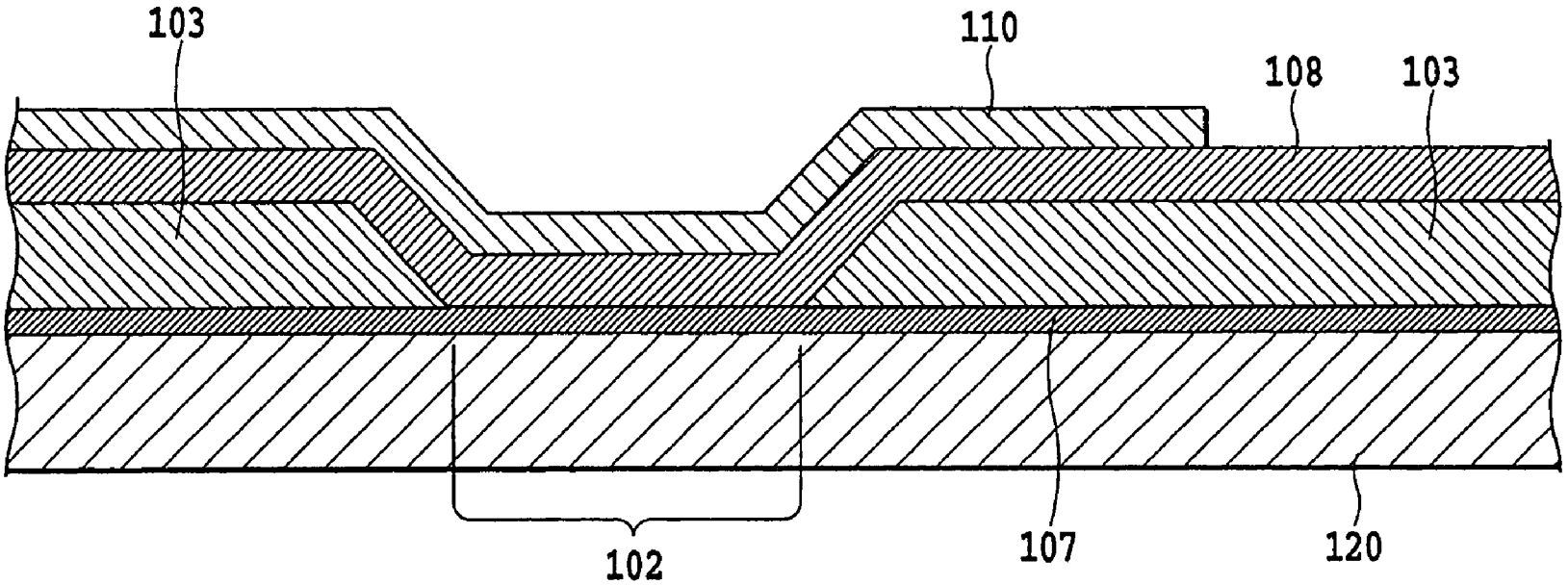
FIG.2 PRIOR ART
FIG. 2 is a cross-sectional view taken along the line II-II of FIG. 1.
Figure 3:
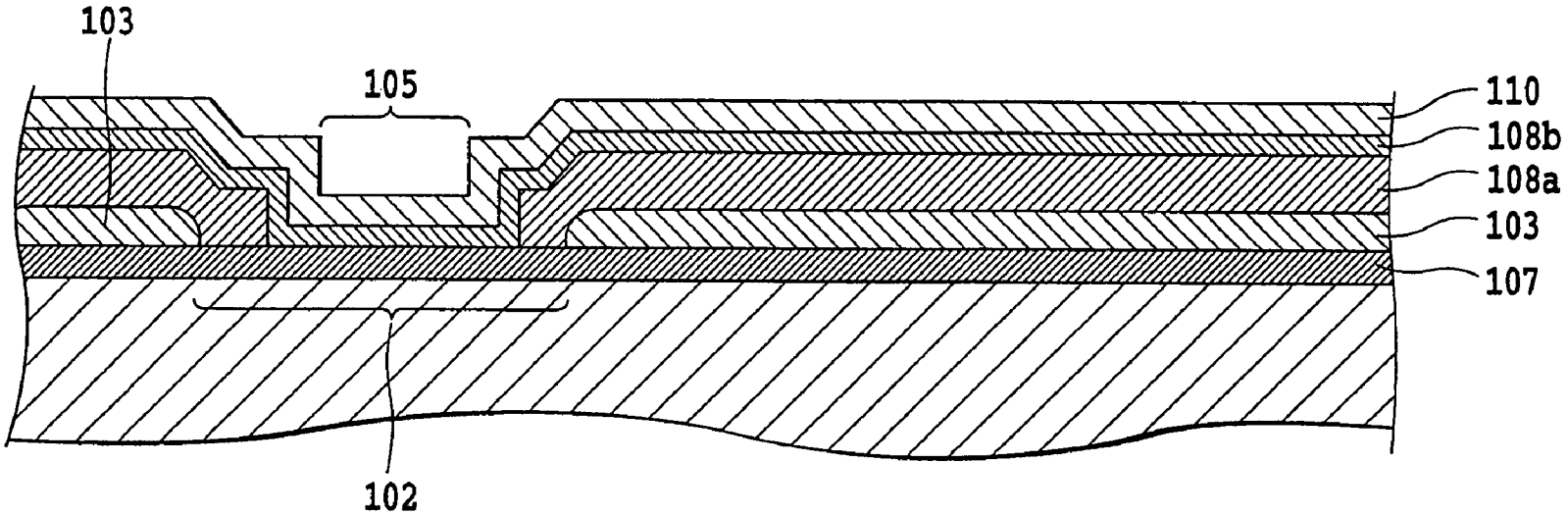
FIG.3 PRIOR ART
FIG. 3 is a schematic cross-sectional view showing a heater in another conventional ink jet head circuit board.
Figure 4:
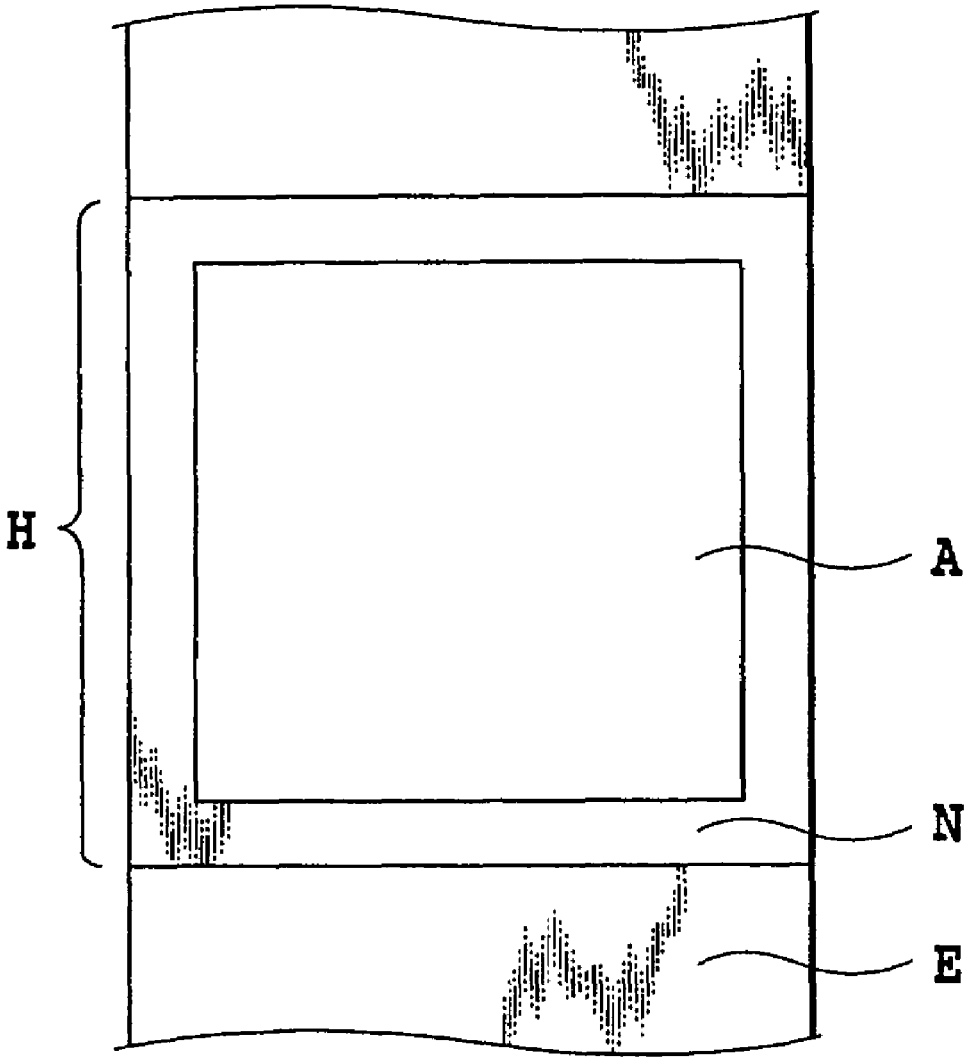
FIG.4 PRIOR ART
FIG. 4 is an explanatory diagram showing an effective bubble generation area on the heater.
Figure 5:
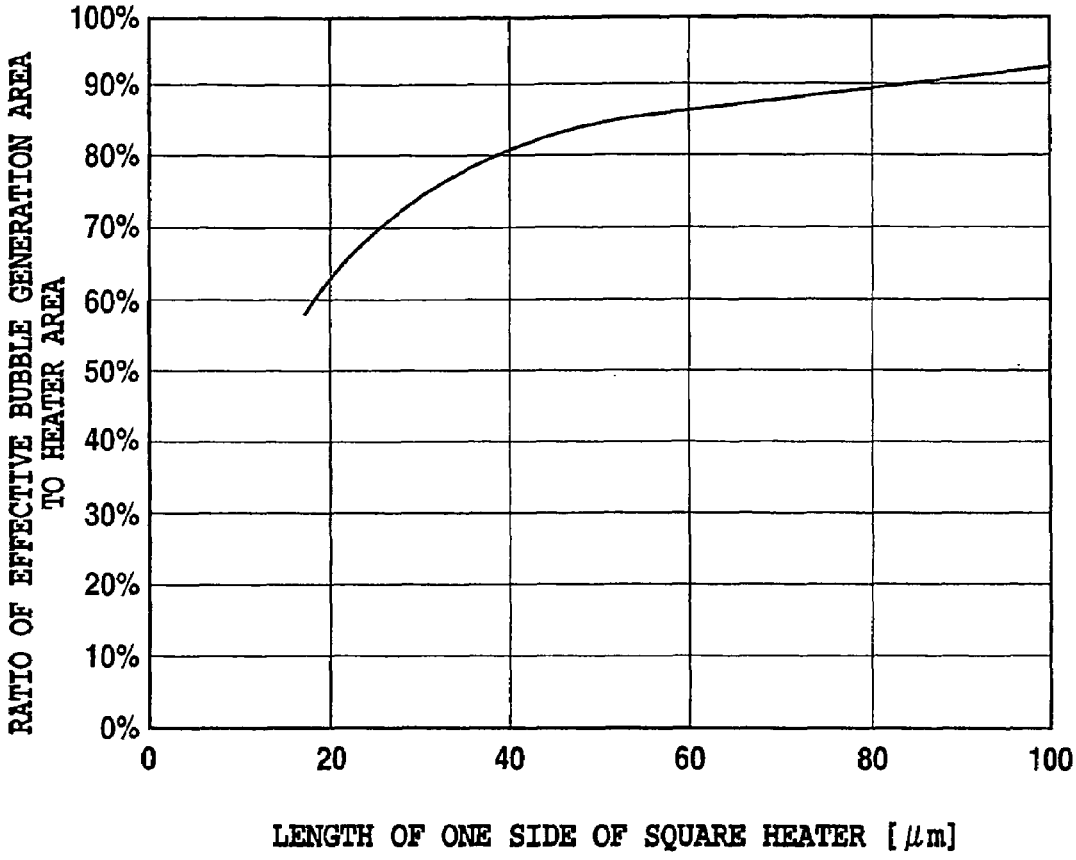
FIG.5 PRIOR ART
FIG. 5 a graph showing a relation between a size of the heater and a thermal efficiency.
Figure 6:
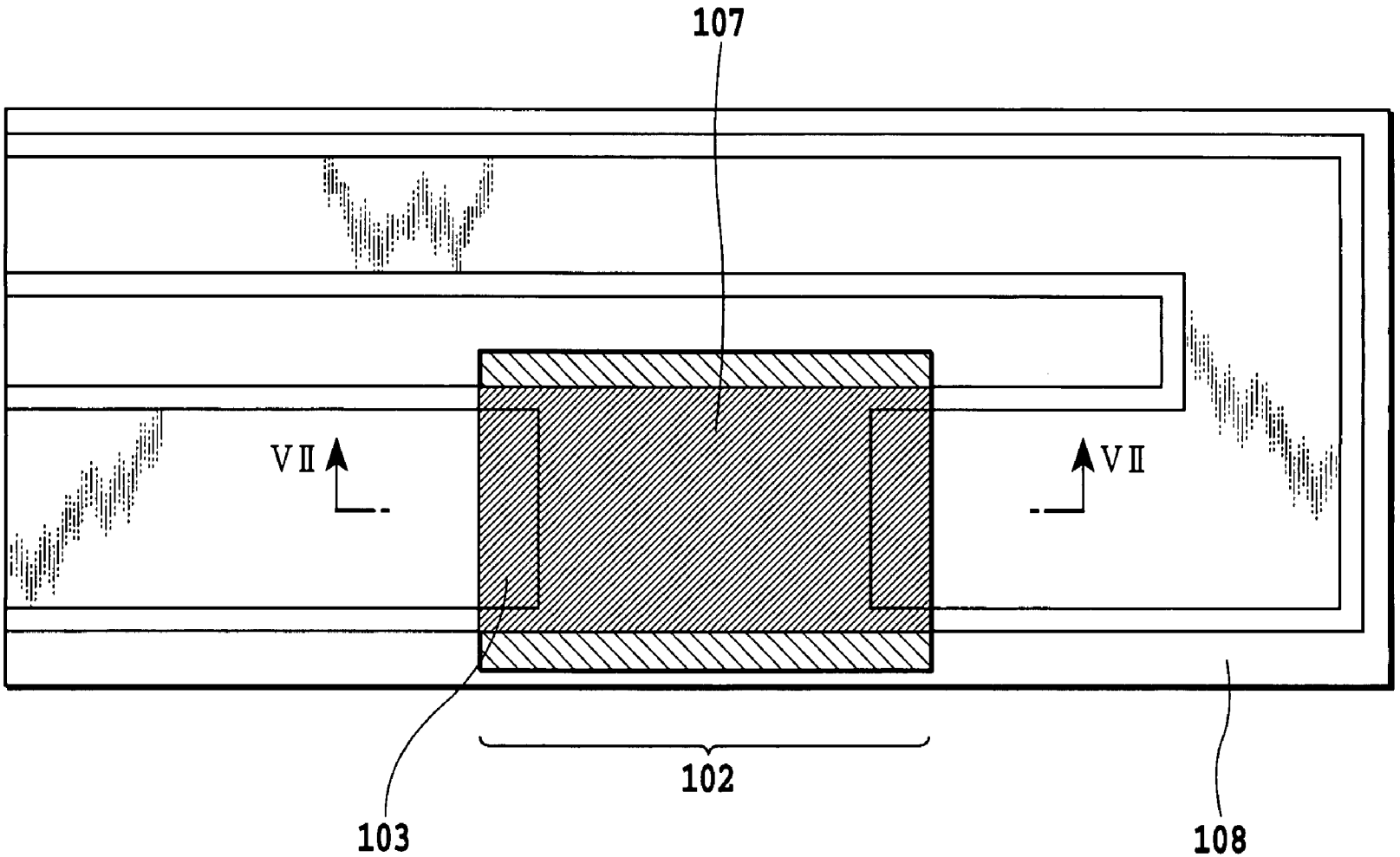
FIG. 6 is a schematic plan view showing a heater in an ink jet head circuit board according to a first embodiment of this invention.
Figure 7:
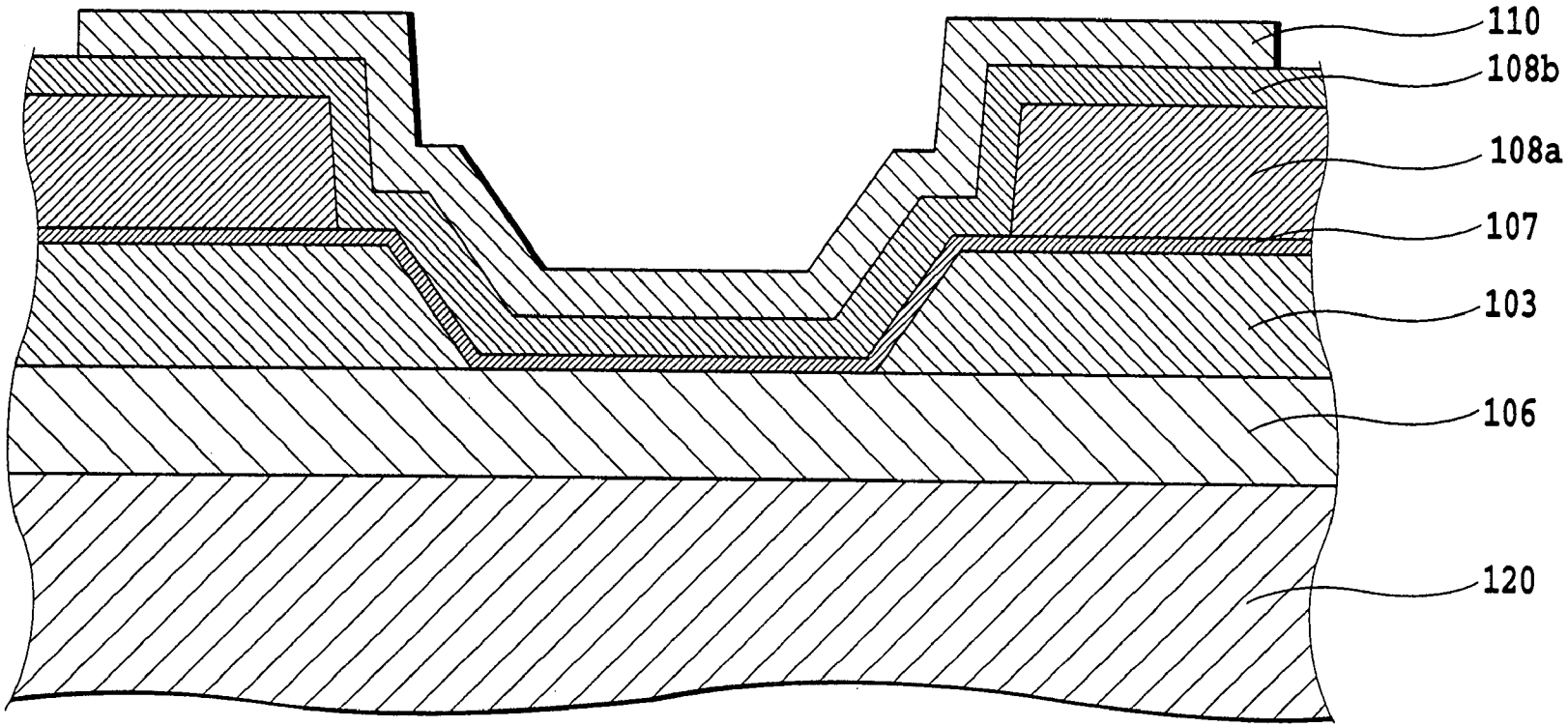
FIG. 7 is a cross-sectional view taken along the line VII-VII of FIG. 6.

FIG. 6 and FIG. 7 are a schematic plan view showing a heater in the ink jet head circuit board according to the first embodiment of this invention and a schematic cross-sectional view taken along the line VII-VII of FIG. 7, respectively. In these figures, components that function in the same way as those in FIG. 1 to FIG. 4 are given like reference numbers.

This embodiment, as in Japanese Patent No. 3382424, employs a basic construction in which an insulating protective layer is formed in two layers (108*a*, 108*b*) and in which one of the two layers (first protective insulation layer 108*a*) is removed from above heater 102, areas associated with power consumption of the ink jet head, to reduce an effective thickness of the protective layer above the heater. Further, in addition to having the above basic construction, this embodiment performs patterning of the electrode wire layer 103 over a heat accumulating layer 106 formed on the substrate 120 and then forms a resistor layer 107 over the electrode wire layer 103.

Referring to FIG. 8 through FIG. 11, an embodiment of a method for manufacturing an ink jet head circuit board shown in FIG. 6 and FIG. 7 will be explained. FIG. 8A, FIG. 9A and FIG. 10A represent schematic cross-sectional views showing a heater and its associated components in the circuit board. FIG. 8B, FIG. 9B and FIG. 10B represent schematic plan views showing the same. Although the manufacturing process described below is performed on a Si substrate 120 or a substrate 120 in which drive circuits made up of semiconductor devices, such as switching transistors, to selectively drive the heater 102 are built in advance, the substrate 120 is not shown in the following drawings for the purpose of simplicity.

Figure 8A:
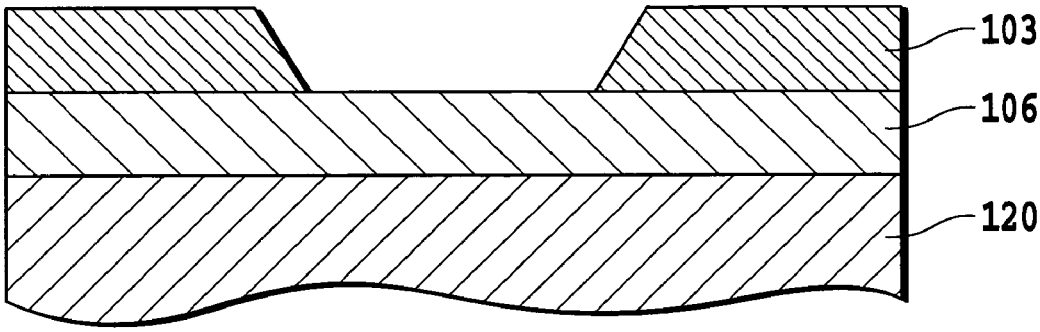
FIG. 8A and FIG. 8B are a schematic cross-sectional view and a schematic plan view, respectively, explaining the process of manufacturing the circuit board shown in FIG. 6 and FIG. 7.
Figure 8B:
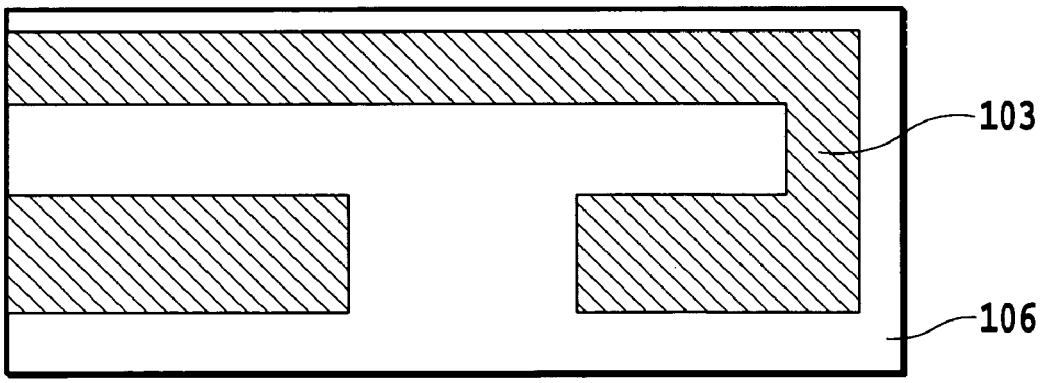

First, as shown in FIG. 8A and FIG. 8B, the substrate 120 is deposited, as by thermal oxidation method, sputtering method and CVD method, with a heat accumulating layer 106 of $SiO_2$, over which a resistor layer is formed. On a substrate 120 with drive circuits built into in advance, the heat accumulating layer 106 may be formed during the manufacturing process of these drive circuits. Next, an Al layer that forms an electrode wire layer 103 is sputtered to a thickness of about 300 nm and then dry-etched using photolithography to form a plan view pattern as shown in FIG. 8B. It is preferred that the end portions of the patterned electrode wire layer be tapered to improve the coverage of layers to be deposited in later processes. In this embodiment, a reactive ion etching (RIE) method is used as a dry etching. In general dry etching of Al or Al alloy used as the electrode wire layer, a gas mixture of $BCl_3$ and $Cl_2$ is introduced. To produce a tapered profile of the electrode wire layer, fluorine gases such as $CF_4$ and $SF_6$ are added. Adding gases such as $CF_4$ and $SF_6$ facilitates backward receding of resist, thus forming a smooth tapered cross section.

Next, over the electrode wire layer 103 a resistor layer 107 of, say, TaSiN is deposited, by reactive sputtering, to a thickness of about 50 nm. At this time, immediately before depositing the resistor layer 107, a reverse sputtering operation (radio frequency etching) is executed to etch away several nm from the substrate surface to expose a clean surface. This reverse sputtering is performed in the same apparatus in which the resistor layer is formed, by applying a RF field to the substrate in the presence of Ar gas.

Figure 9A:
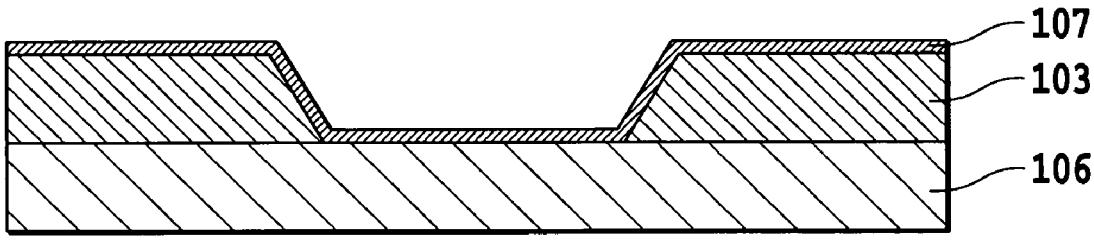
FIG. 9A and FIG. 9B are a schematic cross-sectional view and a schematic plan view, respectively, explaining the process of manufacturing the circuit board shown in FIG. 6 and FIG. 7.
Figure 9B:
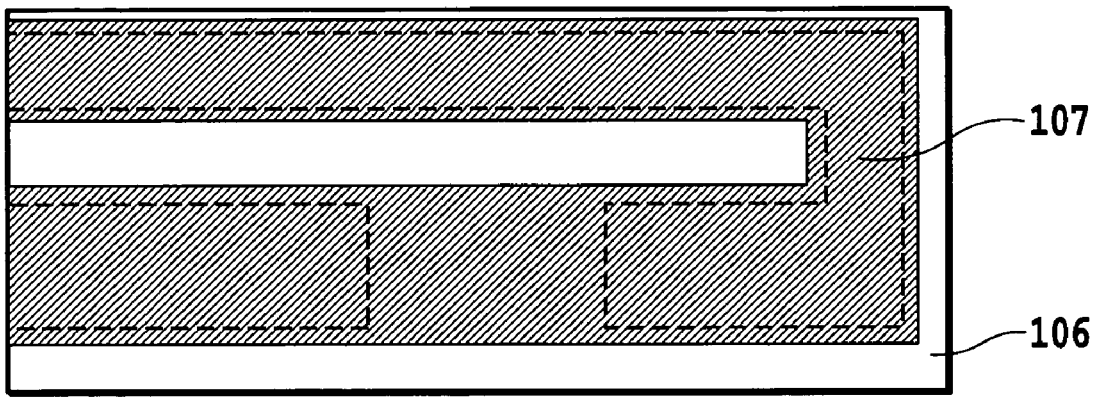

By performing the reverse sputtering (radio frequency etching) as described above, a clean surface is exposed and edges at the ends of the electrode wire layer are removed to form a smoother tapered profile and to improve the coverage of the electrode wire layer. Then, the reactive ion etching (RIE) method using photolithography is performed to form a desired pattern of the resistor layer 107 over the electrode wire layer 103 and the heater 102, as shown in FIG. 9A and FIG. 9B.

Figure 10A:
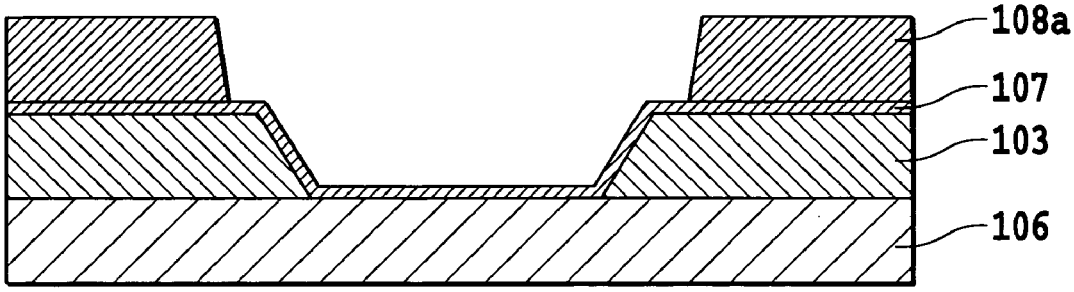
FIG. 10A and FIG. 10B are a schematic cross-sectional view and a schematic plan view, respectively, explaining the process of manufacturing the circuit board shown in FIG. 6 and FIG. 7.
Figure 10B:
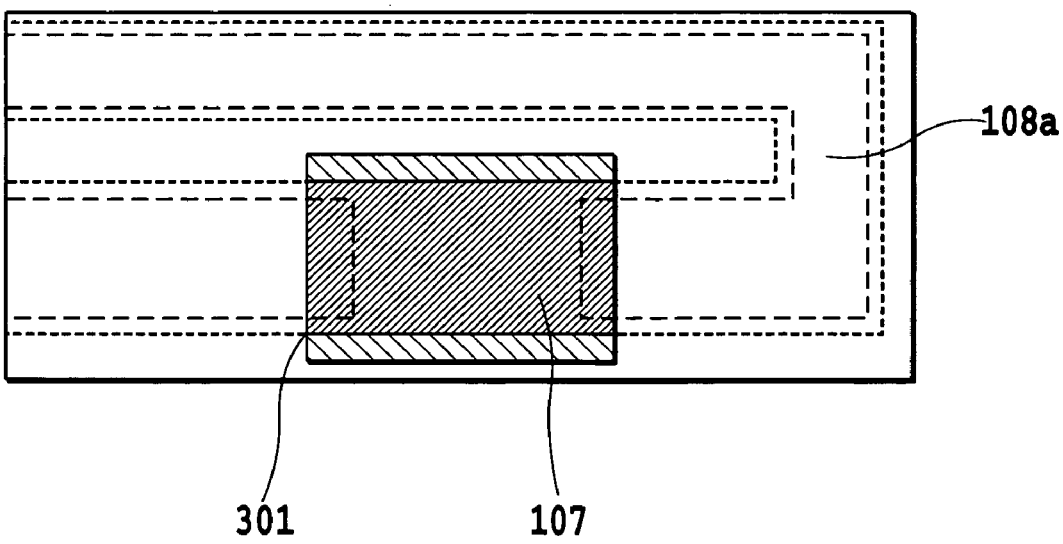

Next, a SiO layer that forms the first protective insulation layer 108*a* is deposited by a plasma CVD method to a thickness of about 200 nm. Then, as shown in FIG. 10A and FIG. 10B, with the resistor layer 107 as an etch stopper, the SiO layer is etched away from above the heater 102 (a portion indicated at 301 in the figure). At this time, the area 301 is patterned outside the heater 102. This process is done by wet etching using photolithography.

Figure 11:
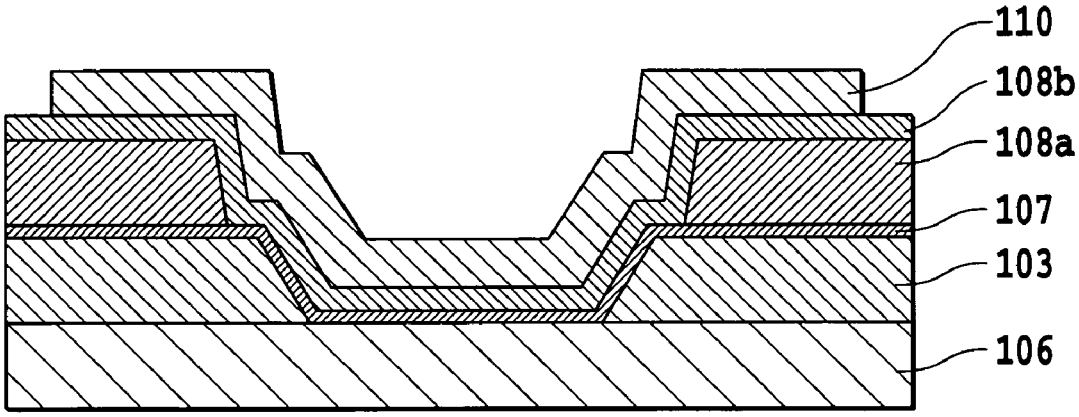
FIG. 11 is a schematic cross-sectional view explaining the process of manufacturing the circuit board shown in FIG. 6 and FIG. 7.

Then, a SiN layer that forms the second protective insulation layer 108*b* is deposited by a plasma CVD method to a thickness of about 200 nm. Further, a Ta layer 110 as an anticavitation and ink resistant layer is sputtered to a thickness of about 230 nm and then dry-etched into a desired shape as shown in FIG. 11 by using photolithography. The Ta layer has a higher heat conductivity than the protective insulation layer and thus does not significantly reduce the thermal efficiency. This is also true of other embodiments described later.

This embodiment, as in Japanese Patent No. 3382424, adopts a basic construction in which the insulating protective layer is formed of two layers and in which one of the two protective insulation layers (first protective insulation layer 108*a*) is removed from above the heater 102, which is associated with power consumption of the ink jet head, to reduce an effective thickness of the protective layer. In this basic construction, where a step coverage needs to be improved, i.e., on the wire pattern, both of the protective insulation layers are used to make the insulation protective layer thick, thereby reducing power consumption while maintaining reliability.

In addition to the above basic construction, this embodiment patterns the electrode wire layer 103 over the heat accumulating layer 106 formed on the substrate 120 and then deposits the resistor layer 107 over the electrode wire layer 103. This construction produces the following notable effects.

First, since the resistor layer 107 covers the electrode wire layer 103, including those portions outside the stepped portions of the wire ends facing the heater 102, a layer removing patterning can be done so that the first protective insulation layer 108*a* can be removed not only from the heater but also from outside the wire ends, i.e., from an area wider than the end-to-end gap of the electrode wire layer 103 forming the heater 102. Compared with the conventional construction in which the first protective insulation layer 108*a* is removed from an area shrunk inwardly of the heater 102 from the wire ends, the construction of this embodiment has an advantage of being able to prevent a reduction in the effective bubble generation area. This construction is particularly effective in reducing the area of the heater to minimize ink ejection volumes and thereby achieve higher resolution and image quality.

Using the process described above, the inventors of this invention manufactured an ink jet head having square heaters (26 μm on one side). For comparison with this head, the inventors also fabricated another ink jet head capable of ejecting ink droplets of virtually equal size by using the fabrication method disclosed in Japanese Patent No. 3382424. The same test images were formed by these two print heads. The comparison found that the ink jet head manufactured by the process of this embodiment consumed nearly 10% less electricity. It was also found that the print head of this embodiment has almost as high durability as the comparison example.

When an ambient temperature during the protective layer forming process exceeds 400° C., the formation of hillocks on the Al and Al alloy generally used in electrode wire layers becomes significant. These hillocks will degrade the coverage of the electrode wire layer and thus the protective layer for the electrode wire layer needs to have a sufficient thickness. However, if a resistor layer is formed on the electrode wires, the formation of hillocks can be suppressed even when the temperature during the protective layer formation exceeds 400° C. because the presence of the resistor layer containing a high-melting point metal can prevent hillock formation.

Further, since, before the resistor layer 107 is formed, a reverse sputtering is performed on the substrate that was patterned with the electrode wire layer 103, spikes or projections formed on the tapered portions during the patterning of the electrode wire layer 103 can be eliminated, thus preventing possible degradations of the coverage.

Further, since the electrode wire layer 103 is formed prior to the formation of the resistor layer 107, the patterning of the electrode wire layer can be done by RIE. This offers the following advantages.

Figure 12A:
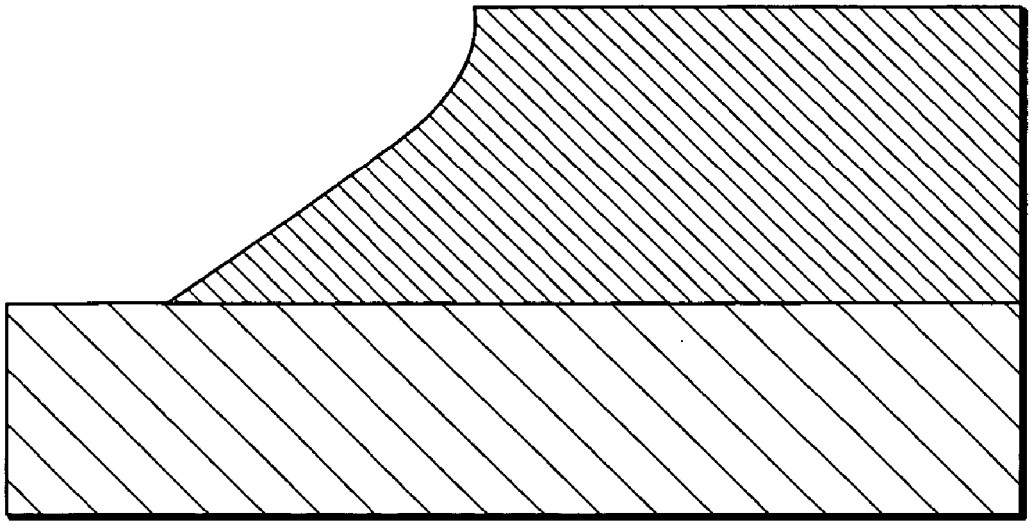
FIG. 12A and FIG. 12B are schematic cross-sectional views showing a tapered layer formed by a wet etching and another tapered layer formed by a reactive ion etching.
Figure 12B:
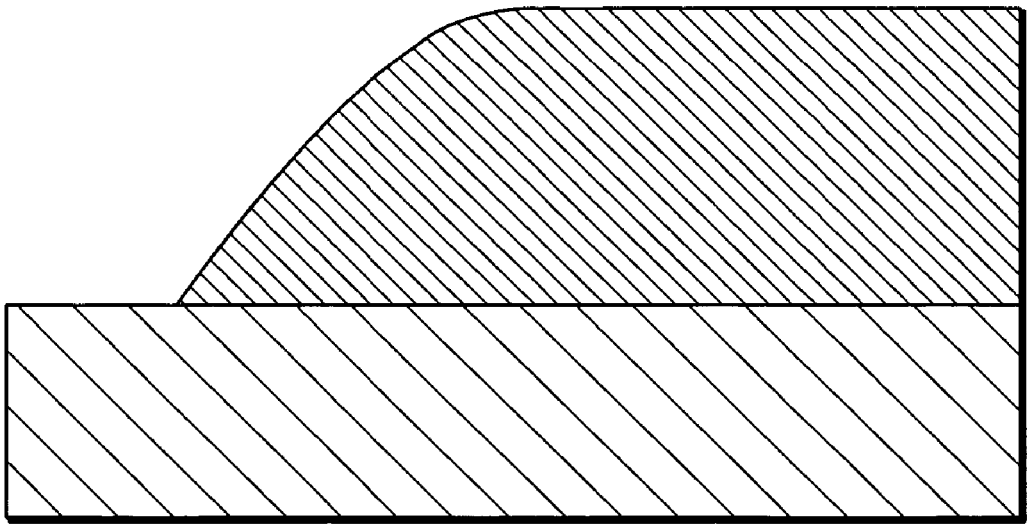

FIG. 12A and FIG. 12B show a tapered profile formed by wet etching and another tapered profile formed by etching a resist backward by reactive ion etching. In the wet etching, the etching proceeds isotropically resulting in a curved cross section as shown in FIG. 12A. On the other hand, when a gas for etching the resist is added as described above, the pattern edge portion of the resist is progressively etched backward and the exposed portion of the electrode wire layer gradually increases, thus forming a smooth profile.

Therefore, forming the resistor layer over the patterned electrode wire layer as described above can improve the coverage of the resistor layer and also allows the stepped portions of the electrode wire layer to be protected reliably by a thinner protective insulation layer 108*b* and an anticavitation layer.

Second Embodiment of Ink Jet Head Circuit Board

The first embodiment concerns an ink jet head circuit board in which, as shown in FIG. 6, one heater is provided on the electrode wire for one nozzle. The present invention can also be applied effectively to an ink jet head circuit board in which two or more heaters are provided on the electrode wire for one nozzle.

Figure 13:
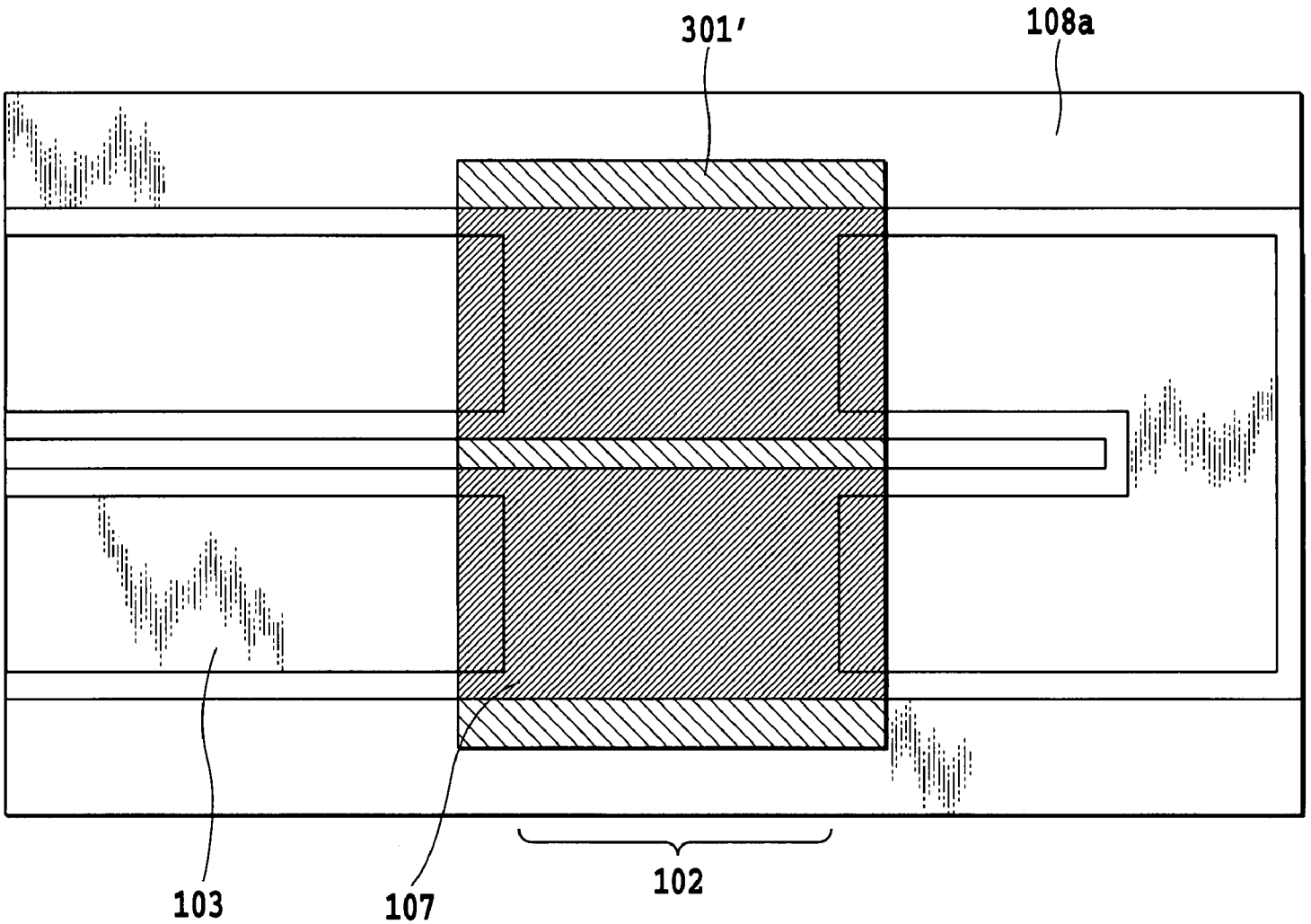
FIG. 13 is a schematic plan view showing a heater in an ink jet head circuit board according to a second embodiment of this invention.

FIG. 13 shows one such example and is a schematic plan view of a construction in which two heaters 102 are provided in series on an electrode wire 103 for one nozzle. The two heaters are formed simultaneously by the same process as that of the first embodiment, i.e., by forming or patterning the resistor layer over the formed or patterned electrode wire layer 103. Then, the first protective insulation layer 108*a* is formed over the resistor layer and then removed from an area 301' to form a pattern shown in FIG. 13.

This construction has an advantage that since the two heaters combined offer a high resistance, a heat loss by other than the heaters (such as wire resistance) can be reduced. Other notable advantages are described below.

When a technique disclosed in Japanese Patent No. 3382424 is used, the first protective insulation layer 108*a* must be removed from an area smaller than and situated inside each of the heaters 102. So, if the areas of the first protective layer removed from the two heaters differ, the effective bubble generation areas naturally differ. This means the bubble generation conditions at the two heaters (bubble generation timing and size of bubble formed) differ. In this construction, since the two bubbles produced by boiling on the two heaters are used as a driving force to eject ink, the differing bubble generation conditions have great influences on the ink ejection characteristics, degrading the printed quality. If this invention is applied, on the other hand, the patterning to remove the first protective insulation layer 108*a* can be done on the outside of those end portions of the electrode wire facing each of the heaters. This method does not affect the effective bubble generation areas which are therefore equal at the two heaters. This means that the bubble generation conditions can be made equal among individual nozzles. This invention therefore is free from the problems experienced with the conventional technique.

Third Embodiment of Ink Jet Head Circuit Board and Process of Manufacturing the Same In the ink jet heads using thermal energy for ink ejection, there are growing demands for increasing the number of nozzles for further miniaturization and higher integration density of circuit board in order to meet the requirements of higher resolution, higher image quality and faster speed. In response to this trend, the number of heaters provided in the circuit board is also increasing and the associated technologies to fabricate the circuit board in small size and at high integration density are being called for. This in turn calls for improved heat efficiency and reduced power consumption. From the standpoint of power saving, it is strongly desired that the resistance of the electrode wires connected to the heater resistors be reduced. The resistance reduction of electrode wire is normally achieved by increasing the width of the electrode wire formed on the substrate. However, as the number of energy generation portions formed on the substrate becomes extremely large for the reasons described above, enough space to allow for increased widths of electrode wires cannot be secured without increasing the size of the circuit board.

Figure 14A:
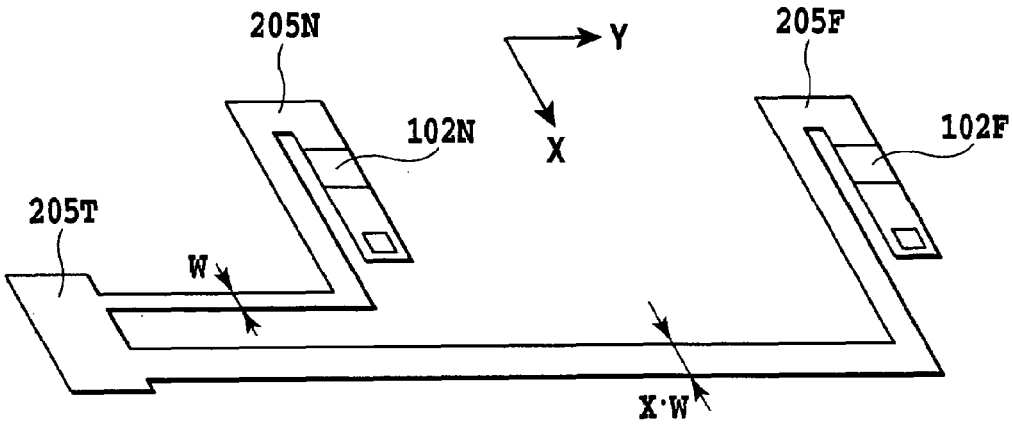
FIG. 14A and FIG. 14B are diagrams explaining the problems of the conventional construction in reducing or equalizing the resistance of the electrode wires leading to heaters and also showing a superiority of a basic construction employed in a third embodiment of this invention.

This is explained by referring to FIG. 14A.

In the case of FIG. 14A, suppose a wire pattern 205N for a heater 102N near a terminal 205T located at an end of the circuit board (not shown) has a width W in its wire portion extending in Y direction. Then, a wire pattern 205F for a heater 102F remote from the terminal 205T has a width x·W (x>1) in its wire portion extending in Y direction in the figure. This is because the distance from the terminal 205T to each heater, i.e., the length of wire, is not uniform and its resistance varies with the distance from the terminal 205T. As described above, in a construction designed to reduce or equalize the wire resistances in the same plane, the circuit board is required to have an area that matches the sum of the widths of wire portions for individual heaters (the farther the heater is from the terminal, the larger the width of the associated wire portion becomes).

Thus, when it is attempted to increase the number of heaters to achieve a higher resolution and quality of printed images and a faster printing speed, the size of the circuit board in X direction increases even more significantly, pushing up the cost and limiting the number of heaters that can be integrated. As for the wire portions in direct vicinity of the heaters, increasing the width in Y direction to reduce the wire resistance can impose limitations on the intervals of heaters and the high density arrangement of nozzles.

To deal with this problem, the inventors of this invention studied a construction in which a plurality of electrode wires are stacked through protective insulation layers to prevent an increase in size of the substrate or circuit board and to ensure a high-density integration of the heaters.

Figure 14B:
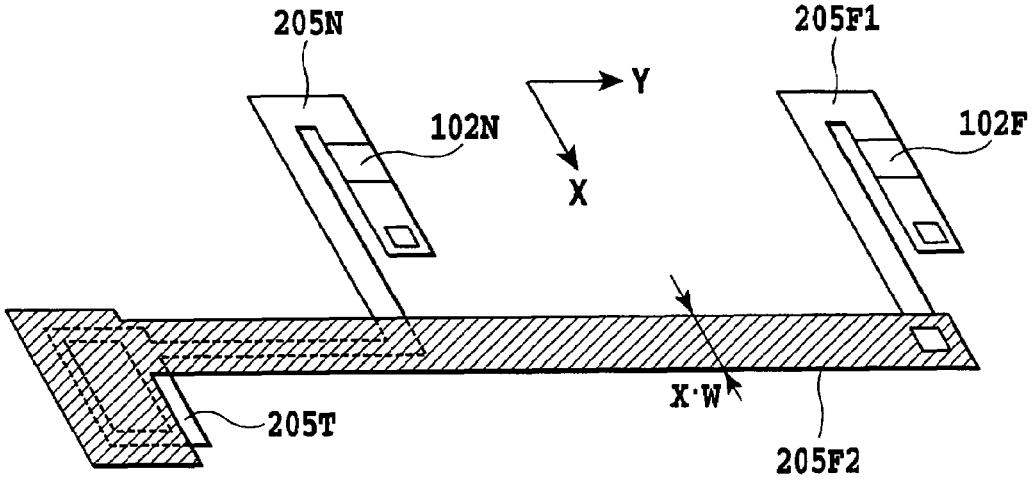

In the construction that uses a plurality of layers for the electrode wires to reduce or equalize wire resistances, as shown in FIG. 14B, the wire pattern 205N for the heater 102N near the terminal 205T and the wire pattern 205F1 in direct vicinity of the heater 102F, which is remote from the terminal 205T, are both formed of the lower layer or the first electrode wire layer, and a wire portion 205F2 extending in Y direction to the wire portion 205F1 is formed of the upper layer or the second electrode wire layer, with the ends of the wire portion 205F2 connected to the terminal 205T and the wire portion 205F1 via through-holes. In this construction, the circuit board is only required to have an area large enough to accommodate the width (x·W) of the upper wire portion 205F2, making it possible to reduce the surface area of the circuit board while at the same time reducing or equalizing the wire resistance.

In addition to the basic construction of this invention, the third embodiment, therefore, employs a construction in which the electrode wires are formed of a plurality of layers to realize a high-density integration of heaters designed to prevent an increase in the size of the circuit board, reduce the wire resistance and realize a higher resolution printing, higher image quality and faster printing speed. The construction of the third embodiment is also intended to increase heat efficiency and reduce power consumption.

Figure 15A:
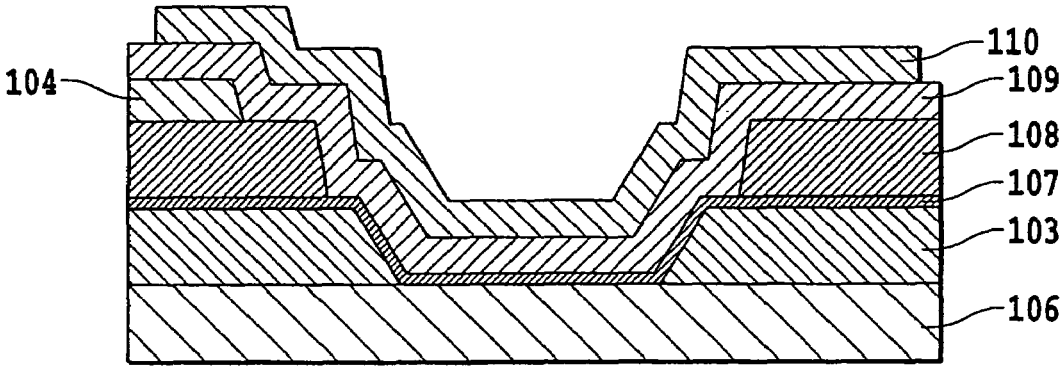
FIG. 15A and FIG. 15B are a schematic cross-sectional view and a schematic plan view, respectively, showing a heater in an ink jet head circuit board according to a third embodiment of this invention.
Figure 15B:
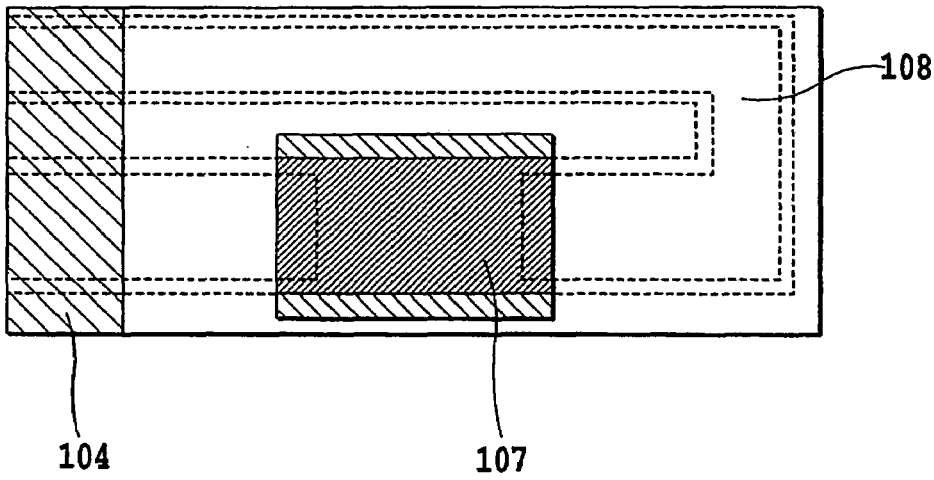

FIG. 15A and FIG. 15B are schematic cross-sectional views showing a heater in an ink jet head circuit board according to the third embodiment of this invention. In these figures, components that function in the same way as those of the first embodiment are assigned like reference numbers.

In this construction, over the resistor layer 107 covering the underlying electrode wire layer 103, an electrode wire layer 104 is formed through the first protective insulation layer 108. These electrode wire layers (the lower layer is referred to as a first electrode wire layer and the upper layer as a second electrode wire layer) are interconnected via through-holes not shown. Over the second electrode wire layer 104 and the heater 102 is formed a second protective insulation layer 109 which protects and insulates them from ink. An anticavitation layer 110 is formed at a location corresponding to the heater 102. The first protective insulation layer 108 is removed, as with the first protective insulation layer 108*a* described above, to produce the similar effect to that of the first embodiment. Because the electrode wires are formed in two or more layers, the resistances of wires leading to the heaters are reduced without increasing the area of the electrode wires on the circuit board and the wire resistances can be equalized among the heaters.

Referring to FIG. 16A to FIG. 18, an example method of fabricating the ink jet head circuit board shown in FIG. 15A and FIG. 15B will be explained.

First, in the same process as that shown in FIG. 8A to FIG. 10B of the first embodiment, the substrate 120 is deposited successively with a heat accumulating layer 106, first electrode wire layer 103 and resistor layer 107 to form a heater 102. Over these layers is deposited a first protective insulation layer 108. With the resistor layer 107 as an etch stopper, the first protective insulation layer 108 is removed from above the heater 102 and also from outside the heater. At the same time, through-holes are formed, as required, to connect the first electrode wire layer 103 to the second electrode wire layer 104 to be deposited later. The thickness of the first protective insulation layer 108 is so set as to fully cover the first electrode wire layer 103 and to secure an enough dielectric breakdown voltage with respect to a second electrode wire layer to be formed later. In this embodiment, the first electrode wire layer 103 is formed to a thickness of about 600 nm and the first protective insulation layer 108 is formed of a SiO layer about 600 nm thick.

Figure 16A:
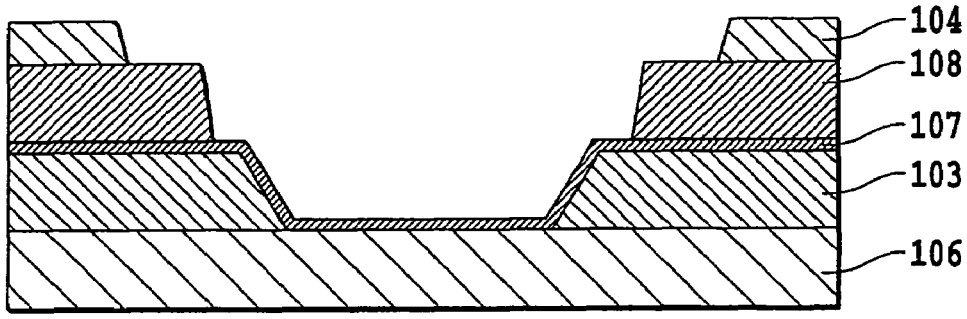
FIG. 16A and FIG. 16B are a schematic cross-sectional view and a schematic plan view, respectively, explaining the process of manufacturing the circuit board shown in FIG. 15A and FIG. 15B.
Figure 16B:
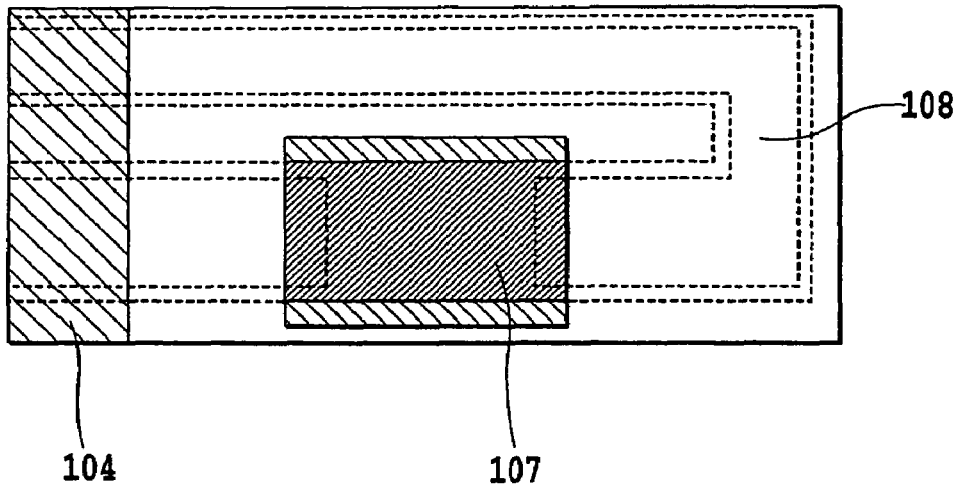

Next as shown in FIG. 16A and FIG. 16B, Al is sputtered to a thickness of about 350 nm to form the second electrode wire layer 104, which is then wet-etched to form a desired pattern using photolithography. By making the second electrode wire layer 104 smaller in thickness than the first protective insulation layer 108, the second protective insulation layer 109 to be deposited later can be reduced in thickness.

Figure 17:
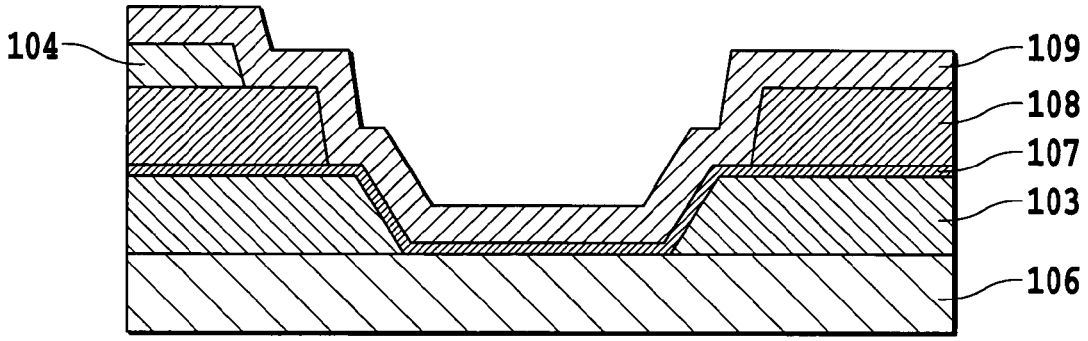
FIG. 17 is a schematic cross-sectional view explaining the process of manufacturing the circuit board shown in FIG. 15A and FIG. 15B.
Figure 18:
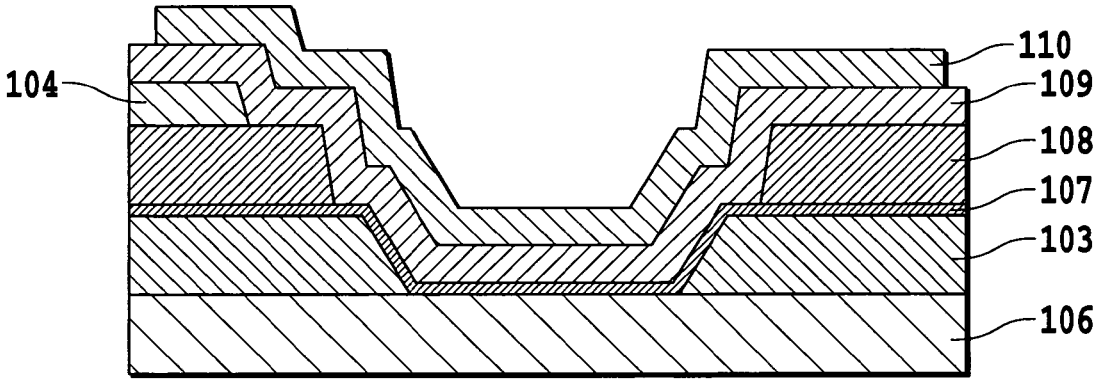
FIG. 18 is a schematic cross-sectional view explaining the process of manufacturing the circuit board shown in FIG. 15A and FIG. 15B.

Then, as shown in FIG. 17, a SiN layer is formed as the second protective insulation layer 109 by using the plasma CVD method. This layer 109 has a thickness of about 300 nm in this embodiment, which allows this layer to fully cover the second electrode wire layer 104 but does not degrade the heat conductivity. Further, a Ta layer 110 as an anticavitation and ink resistant layer is sputtered to a thickness of about 230 nm and then dry-etched into a desired pattern by using photolithography. A resultant structure shown in FIG. 18 is obtained.

While in the embodiment described above, the electrode wires for the heater 102 are constructed in two layers, the same philosophy can also be applied to constructions in which three or more layers of electrode wires are provided, for example, by stacking a third electrode wire layer and a third protective layer over the second protective insulation layer 109.

Example Construction of Ink Jet Head

Now, an ink jet head using the circuit board of one of the above embodiments will be explained.

Figure 19:
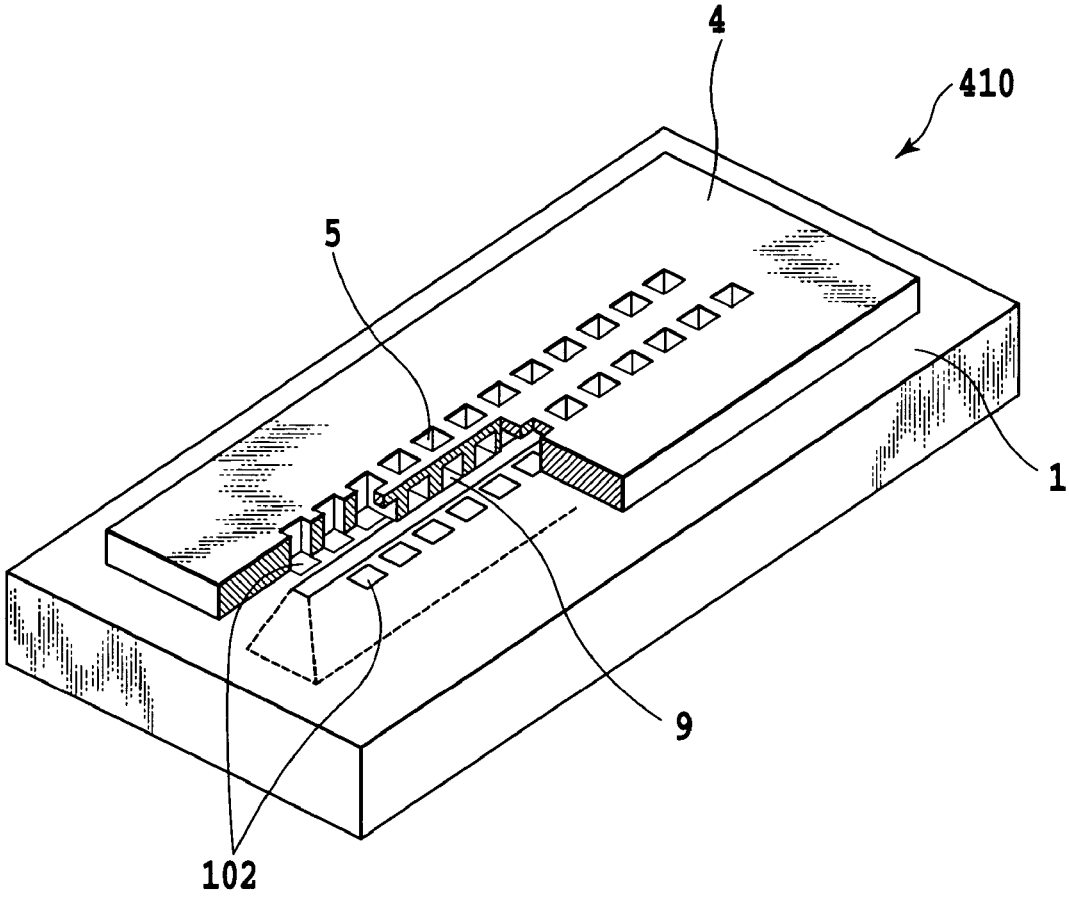
FIG. 19 is a perspective view showing an example ink jet head constructed of the circuit board of one of the first to third embodiment.

FIG. 19 is a schematic perspective view of an ink jet head.

This ink jet head has a circuit board 1 incorporating two parallel columns of heaters 102 arrayed at a predetermined pitch. Here, two circuit boards manufactured by the above process may be combined so that their edge portions where the heaters 102 are arrayed are opposed to each other, thus forming the two parallel columns of heaters 102. Or the above manufacturing process may be performed on a single circuit board to form two parallel columns of heaters in the board.

The circuit board 1 is joined with an orifice plate 4 to form an ink jet head 410. The orifice plate has formed therein ink ejection openings or nozzles 5 corresponding to the heaters 102, a liquid chamber (not shown) to store ink introduced from outside, ink supply ports 9 matched one-to-one to the nozzles 5 to supply ink from the liquid chamber to the nozzles, and a path communicating with the nozzles 5 and the supply ports 9.

Although FIG. 19 shows the two columns of heaters 102 and associated ink ejection nozzles 5 arranged line-symmetrical, they may be staggered by half-pitch to increase the print resolution.

(Ink Jet Head Cartridge and Printing Apparatus)

This ink jet head can be mounted not only on such office equipment as printers, copying machines, facsimiles with a communication system and word processors with a printer unit but also on industrial recording apparatus used in combination with a variety of processing devices. The use of this ink jet head enables printing on a variety of print media, including paper, thread, fiber, cloth, leather, metal, plastic, glass, wood and ceramics. In this specification, a word "print" signifies committing to print media not only significant images such as characters and figures but also nonsignificant images such as patterns.

In the following, a cartridge comprising the above ink jet head combined with an ink tank and an ink jet printing apparatus using this unit will be explained.

Figure 20:
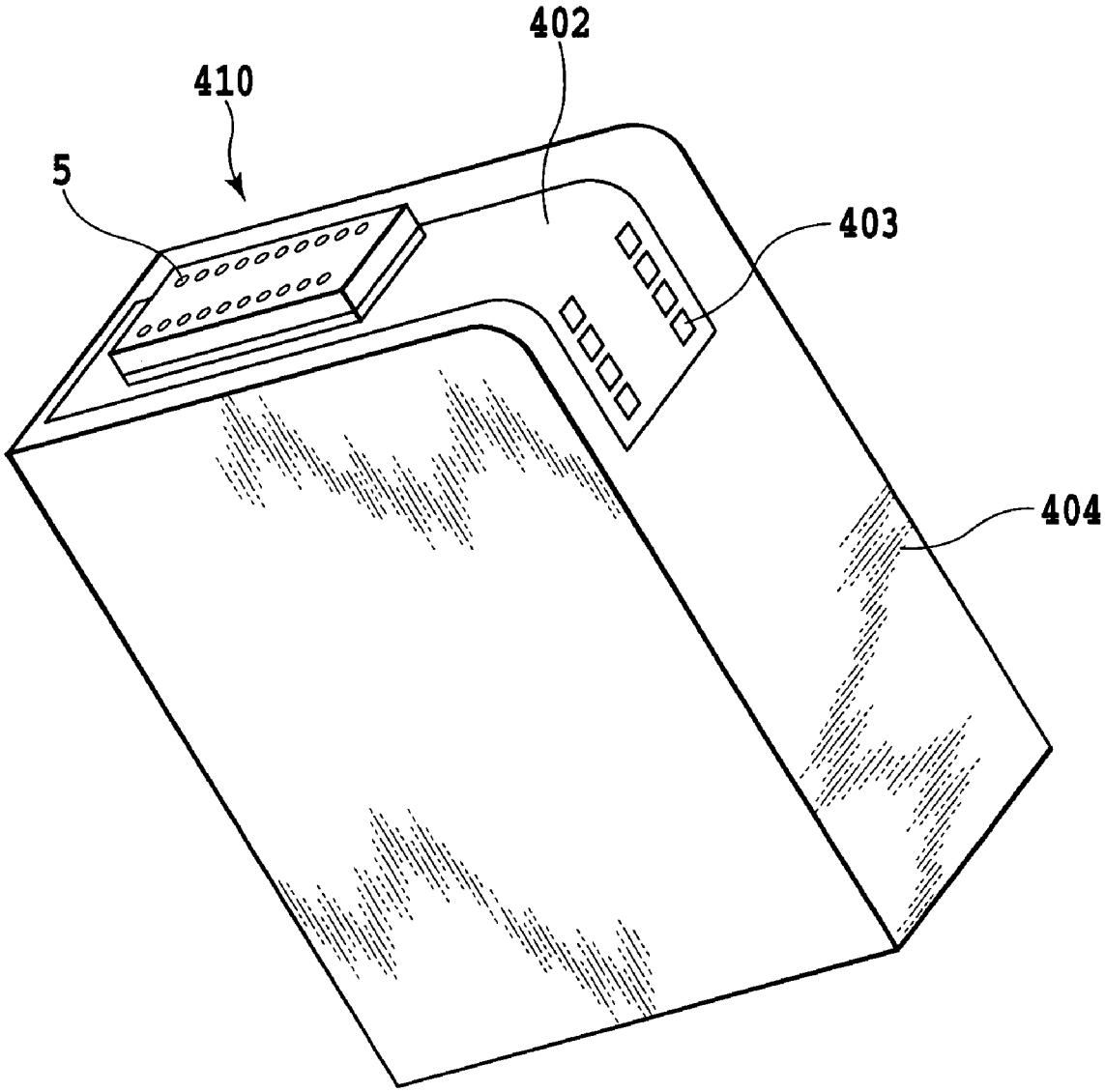
FIG. 20 is a perspective view showing an ink jet cartridge using the ink jet head of FIG. 19.

FIG. 20 shows an example construction of an ink jet head unit of cartridge type incorporating the above ink jet head as its constitutional element. In the figure, denoted 402 is a TAB (tape automated bonding) tape member having terminals to supply electricity to the ink jet head 410. The TAB tape member 402 supplies electric power from the printer body through contacts 403. Designated 404 is an ink tank to supply ink to the head 410. The ink jet head unit of FIG. 20 has a cartridge form and thus can easily be mounted on the printing apparatus.

Figure 21:
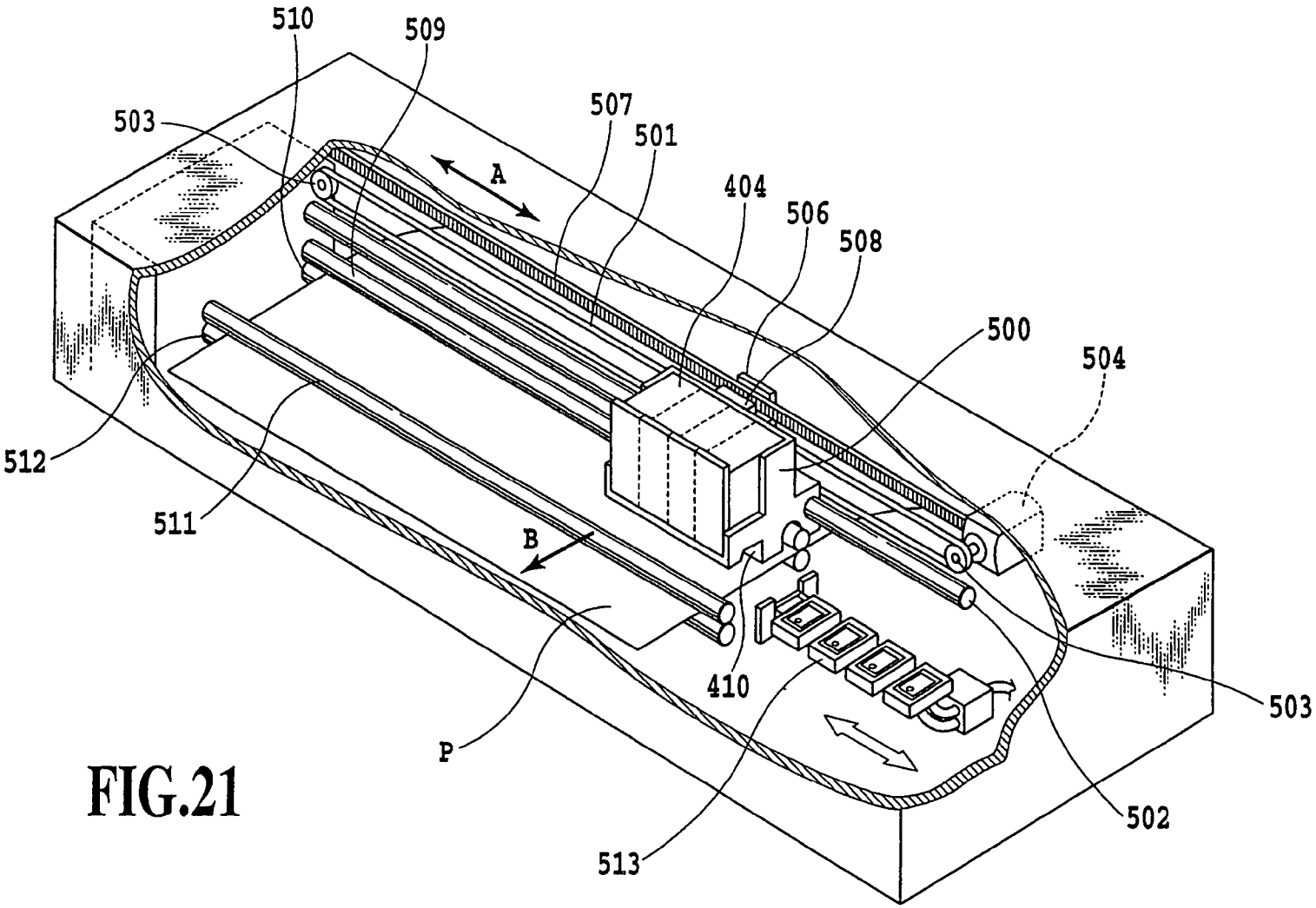
FIG. 21 is a schematic perspective view showing an example construction of an ink jet printing apparatus using the ink jet cartridge of FIG. 20.

FIG. 21 schematically shows an example construction of an ink jet printing apparatus using the ink jet head unit of FIG. 20.

In the ink jet printing apparatus shown, a carriage 500 is secured to an endless belt 501 and is movable along a guide shaft 502. The endless belt 501 is wound around pulleys 503, 503 one of which is coupled to a drive shaft of a carriage drive motor 504. Thus, as the motor 504 rotates, the carriage 500 is reciprocated along the guide shaft 502 in a main scan direction (indicated by arrow A).

The ink jet head unit of a cartridge type is mounted on the carriage 500 in such a manner that the ink ejection nozzles 5 of the head 410 oppose paper P as a print medium and that the direction of the nozzle column agrees with other than the main scan direction (e.g., a subscan direction in which the paper P is fed). A combination of the ink jet head 410 and an ink tank 404 can be provided in numbers that match the number of ink colors used. In the example shown, four combinations are provided to match four colors (e.g., black, yellow, magenta and cyan).

Further, in the apparatus shown there is provided a linear encoder 506 to detect an instantaneous position of the carriage in the main scan direction. One of two constitutional elements of the linear encoder 506 is a linear scale 507 which extends in the direction in which the carriage 500 moves. The linear scale 507 has slits formed at predetermined, equal intervals. The other constitutional element of the linear encoder 506 includes a slit detection system 508 having a light emitter and a light sensor, and a signal processing circuit, both provided on the carriage 500. Thus, as the carriage 500 moves, the linear encoder 506 outputs a signal for defining an ink ejection timing and carriage position information.

The paper P as a print medium is intermittently fed in a direction of arrow B perpendicular to the scan direction of the carriage 500. The paper is supported by a pair of roller units 509, 510 on an upstream side of the paper feed direction and a pair of roller units 511, 512 on a downstream side so as to apply a constant tension to the paper to form a planar surface for the ink jet head 410 as it is transported. The drive force for the roller units is provided by a paper transport motor not shown.

In the above construction, the entire paper is printed by repetitively alternating the printing operation of the ink jet head 410 as the carriage 500 scans and the paper feed operation, each printing operation covering a band of area whose width or height corresponds to a length of the nozzle column in the head.

The carriage 500 stops at a home position at the start of a printing operation and, if so required, during the printing operation. At this home position, a capping member 513 is provided which caps a face of each ink jet head 410 formed with the nozzles (nozzle face). The capping member 513 is connected with a suction-based recovery means (not shown) which forcibly sucks out ink from the nozzles to prevent nozzle clogging.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes.

The present invention has been described in detail with respect to preferred embodiments, and it will now be apparent from the foregoing to those skilled in the art that changes and modifications may be made without departing from the invention in its broader aspects, and it is the intention, therefore, that the appended claims to cover all such changes and modifications.

This application claims priority from Japanese Patent Application No. 2004-236607 filed Aug. 16, 2004, which is hereby incorporated by reference herein.

What is claimed is:

1. An ink jet head circuit board having a heating portion to generate thermal energy for ejecting ink as the heating portion is energized, the ink jet head circuit board compnsing:

a substrate;

a first electrode and a second electrode as a counterpart thereof, the first electrode having a first taper portion in which the thickness of an end portion of the first electrode near an area on the substrate between the first and second electrodes is gradually reduced toward the area, and the second electrode having a second taper portion in which the thickness of an end portion of the second electrode near the area is gradually reduced toward the area;

a resistor layer continuously formed so as to extend on the area, a part of the first electrode including the first taper portion and a part of the second electrode including the second taper portion, the resistor layer on the area being used as the heating portion;

a first insulating layer formed on the resistor layer except at least portions above the area, above the first taper portion and above the second taper portion; and a second insulating layer continuously formed so as to extend on the resistor layer and the first insulating layer, the second insulating layer being smaller in thickness than the first insulating layer.

2. An ink jet head circuit board according to claim 1, wherein the first and second electrodes are formed of aluminum or aluminum alloy.

3. An ink jet head comprising:

the ink jet head circuit board as claimed in claim 1; and an ink ejection nozzle corresponding to the heating portion.

4. An ink jet head circuit board according to claim 1, further comprising a third electrode disposed between the first and second insulating layers and electrically connected with the first electrode, and wherein the third electrode is smaller in thickness than the first and second electrodes.

5. An ink jet head circuit board according to claim 1, wherein the first insulating layer is formed of SiO and the second insulating layer is formed of SiN.

6. An ink jet head circuit board according to claim 5, wherein an ink resistant layer of Ta is formed on an ink contacting portion of the second insulating layer.

* * * * *